United States Patent [19]

Jamali et al.

[11] Patent Number: 4,887,128

[45] Date of Patent: Dec. 12, 1989

[54] METHOD AND APPARATUS FOR REPRODUCING DOCUMENTS WITH VARIABLE INFORMATION

[75] Inventors: Jamal Jamali, Rochester; Tomas Roztocil, Caledonia, both of N.Y.

[73] Assignee: Eastman Kodak Company, Rochester, N.Y.

[21] Appl. No.: 328,737

[22] Filed: Mar. 23, 1989

Related U.S. Application Data

[63] Continuation of Ser. No. 140,709, Jan. 4, 1988, abandoned.

[51] Int. Cl.[4] ..... G03G 21/00

[52] U.S. Cl. ..... 355/202; 355/200; 355/218

[58] Field of Search ..... 355/40, 77, 200, 202, 355/218

[56] References Cited

U.S. PATENT DOCUMENTS

| | | | |
|---|---|---|---|
| 3,807,852 | 4/1974 | Hoydic | 355/201 X |
| 4,012,122 | 3/1977 | McVeigh | 355/202 X |
| 4,268,164 | 5/1981 | Yajima et al. | 355/202 X |
| 4,417,805 | 11/1983 | Kishi | 358/300 |
| 4,551,008 | 11/1985 | Banton | 355/202 |
| 4,552,449 | 11/1985 | Wakamatsu et al. | 355/202 |
| 4,740,818 | 4/1988 | Tsilibes et al. | 355/218 X |
| 4,760,608 | 7/1988 | Suzuki | 358/300 X |
| 4,763,165 | 8/1988 | Watanabe | 355/218 X |
| 4,777,510 | 10/1988 | Russel | 355/218 X |
| 4,791,450 | 12/1988 | Mosehauer et al. | 355/77 X |
| 4,794,421 | 12/1988 | Stoudt et al. | 355/202 |

FOREIGN PATENT DOCUMENTS

| | | |
|---|---|---|
| 87/03707 | 6/1987 | PCT Int'l Appl. . |
| 87/03710 | 6/1987 | PCT Int'l Appl. . |

OTHER PUBLICATIONS

IBM Technical Disclos. Bulletin, vol. 23, No. 10, Mar. 81, p. 4671.

IBM Technical Disclos. Bulletin, vol. 25, No. 8, Jan. 83, p. 4317.

Patent Abs. of Japan, vol. 8, No. 79, (p. 267) (1516).

Patent Abs. of Japan, vol. 8, No. 202 (p. 300) (1639).

*Primary Examiner*—Fred L. Braun

*Attorney, Agent, or Firm*—Norman Rushefsky

[57] ABSTRACT

Method and apparatus are provided for reproducing information on a document sheet so that copies are provided with such information, yet also include additional information that may vary from copy to copy. An electrophotographic reproduction apparatus is provided to optically reproduce the information on the document sheet. The document sheet is provided with a black patch (or placed in a transparent folder having such patch) that is located in the area corresponding to where the variable information is to be written. The document sheet is then placed on a digitizing tablet to provide signals indicative of the area of the black patch. The document sheet is then placed on the exposure platen and optically copied. In response to the signals an LED printhead writes the variable information on the same image frame used to optically copy the original to provide full machine speed copying. The document sheet with black patch may be produced by the apparatus.

14 Claims, 6 Drawing Sheets

METHOD AND APPARATUS FOR REPRODUCING DOCUMENTS WITH VARIABLE INFORMATION

This is a continuation of application Ser. No. 140,709, filed Jan. 4, 1988, now abandoned.

BACKGROUND OF THE INVENTION

1. Field of the Invention

The present invention relates to electrophotographic reproduction apparatus and method and, more specifically, to improvements in reproducing documents with variable information using supplementary electronic writers.

2. Brief Description of the Prior Art

In the prior art as exemplified by U.S. Pat. No. 4,268,164, apparatus is described for producing reproductions of an original wherein the reproductions contain additional variable information. Such reproductions may take the form of letters wherein the body of the letter is the constant information; i.e., the same for all the reproductions but variable information such as addresses or the like will differ from copy to copy in a set of reproductions. In order to accomplish this, the prior art apparatus employs black cover papers or the like which are used to cover the areas on the original corresponding to those where the variable information is to be written. The original with the areas appropriately masked are placed on the exposure platen and a scanning reproduction is made wherein a predetermined time is provided for the copying reproduction of the optically reproduced document portions and a predetermined time is provided for the reproduction of the variable information employing a laser beam scanner or the like.

A problem with the apparatus described is its slowness in reproducing many copies which is typical of optical exposures employing a scanning exposure of the original. A further problem is the need to have information along at least one dimension of the document be either all variable or all constant due to the nature of a scanning type exposure system and timing of the copying operation when not employing the laser beam exposure.

It is, therefore, an object of the invention to provide a highly productive reproduction apparatus for providing reproductions of originals with both constant and variable information.

It is a further object of the invention to provide a reproduction apparatus for providing reproductions of originals with both constant and variable information and wherein the locations of the constant and variable information are more flexible than suggested by the prior art apparatus.

SUMMARY OF THE INVENTION

In accordance with the above objects, the invention is directed to apparatus and method for producing copy with a composite of constant information from an original and additional variable information, the method comprising:

(a) placing the document on a support, the document having a patch-like marking corresponding to the area to receive the variable information and while on the support, having the operator manually select points that identify an area to receive variable information, such selection step causing signals to be created with respect to such points;

(b) generating signals corresponding to variable information to be printed on the copy;

(c) placing the document on an exposure platen;

(d) optically exposing the document onto an image frame of an electrostatically charged photoconductive member to form an electrostatic latent image of the constant information;

(e) in response to signals generated in step (b) separately exposing, using an electronic print source, onto the same image frame an electrostatic latent image of character information in the area of the frame corresponding to the patch-like marking;

(f) developing the latent images formed by the image frame; and (g) transferring the developed image to a receiver sheet to form the copy with the composite information.

The apparatus comprising:

(a) digitizing means for supporting the document and for enabling the operator to manually select points that identify the patched area to receive variable information to generate a first set of signals that are related to the x, y coordinates of each of such points relative to a reference;

(b) means for generating a second set of signals corresponding to variable information to be printed on the copy;

(c) an exposure platen;

(d) a photoconductive member;

(e) means for electrostatically charging the photoconductive member;

(f) exposure means for optically exposing the document onto an image frame of the electrostatically charged photoconductive member to form an electrostatic latent image of the constant information;

(g) means including an electronic print source and responsive to the second set of signals for separately exposing, onto the same image frame an electrostatic latent image of character information in the area of the frame corresponding to the patch-like marking;

(h) means for developing the latent images formed on the image frame; and (i) means for transferring the developed image to a receiver sheet to form the copy with the composite information.

BRIEF DESCRIPTION OF THE DRAWINGS

The subsequent description of the preferred embodiments of the present invention refer to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1A:
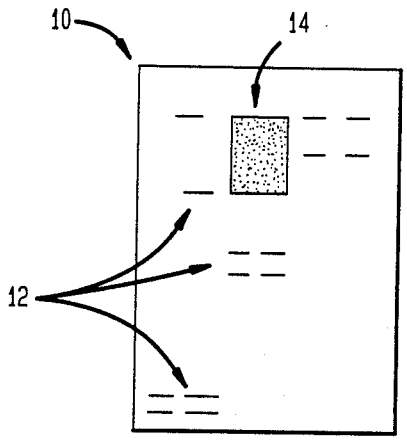
FIG. 1*a* is an illustration of an original document sheet showing a portion thereof overwritten with black patch to denote an area thereof corresponding to where variable information is to be placed.
Figure 1B:
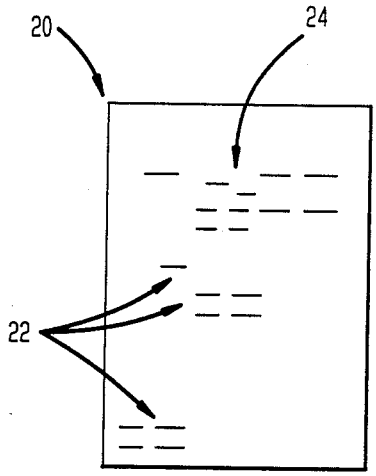
FIG. 1*b* is an illustration of a reproduction formed in accordance with the invention having information reproduced from the original document sheet (constant information) and additional information written thereon (variable original information)

With reference to FIG. 1(*a*), an original document sheet 10 containing information 12 to be reproduced has one or more portions thereof 14 marked with say black ink or tape. These areas or patches defined by this ink or tape represent areas within which additional variable information will be printed. FIG. 1(*b*) illustrates a reproduction 20 of the original document sheet 10 and includes a reproduction 22 of the information 12 on the original (the constant information) and additionally includes a reproduction of variable information 24 which may comprise address information, salutations, etc., that change from copy to copy of a letter that is to be sent to say many different individuals.

Figure 2:
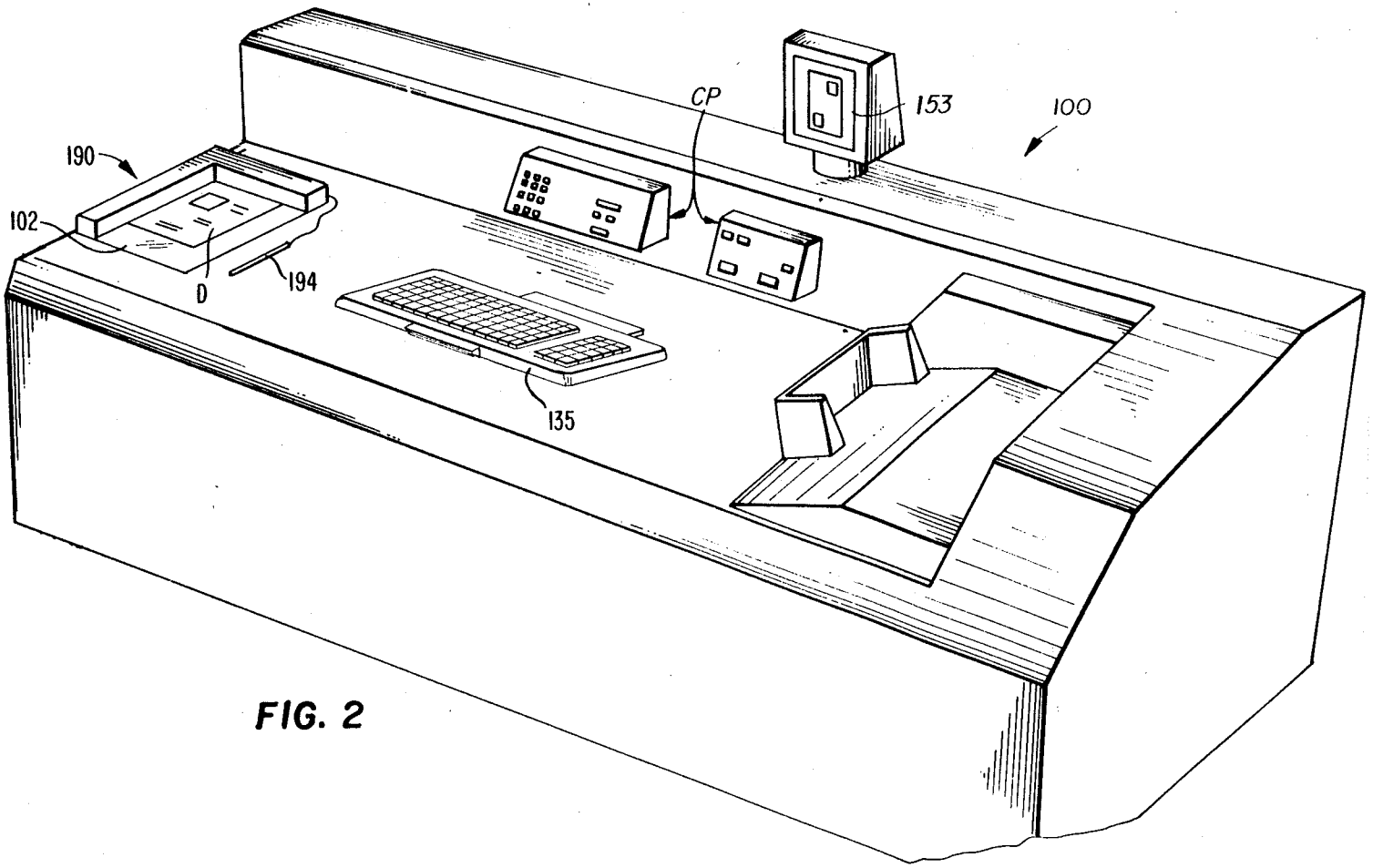
FIG. 2 is a perspective view of an electrophotographic apparatus made in accordance with the invention.
Figure 3:
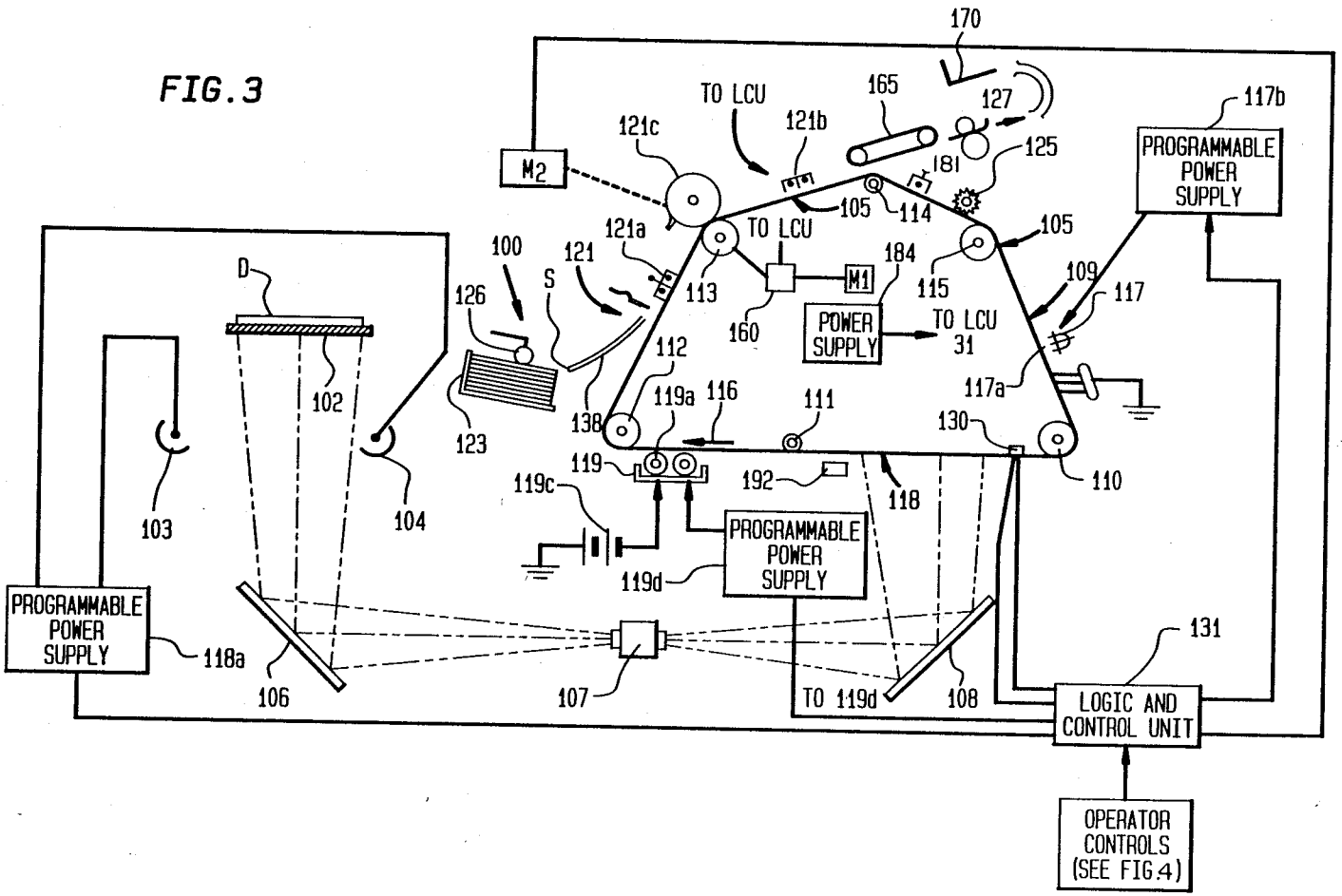
FIG. 3 is a schematic of a side view of the operating elements of the electrophotographic reproduction apparatus of FIG. 2.
Figure 4:
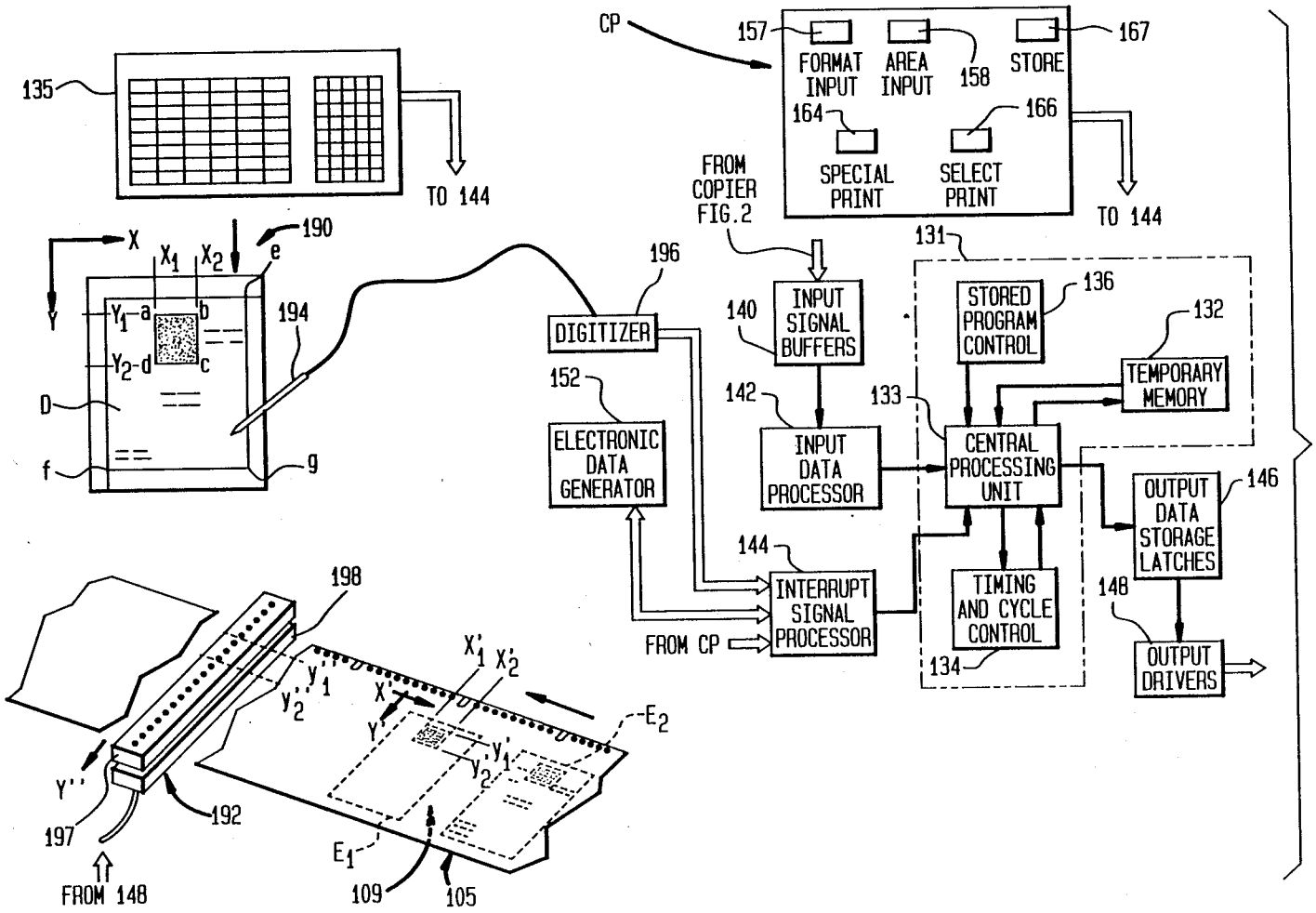
FIG. 4 is a schematic illustrating a data input station and block diagrams of controls for controlling the apparatus of FIG. 2.

Referring now to FIGS. 2–4, there is shown an apparatus 100 which is adapted, in accordance with the present invention, to produce electrophotographic reproductions of documents including a composite of constant and variable information. In this regard, reference is made to the apparatus described in PCT international publication No. WO 87/03710, the contents of which are incorporated herein by this reference.

The electrophotographic reproduction apparatus or copier 100 includes an endless or continuous belt-type photoconductive web 105 that is trained about six transport rollers 110, 111, 112, 113, 114, and 115. Roller 113 is coupled to a drive motor $M_1$ in a conventional manner. Motor $M_1$ is connected to a suitable source of potential (not shown) when a switch (not shown) is closed by a signal from logic and control unit (LCU) 131. When the switch is closed, the roller 113 is driven by the motor $M_1$ and moves the web 105 in a clockwise direction as indicated by arrow 116. This movement causes successive image sectors or frames of the web 105 to sequentially pass a series of electrophotographic work stations of the copier.

For the purpose of the instant disclosure, several copier work stations are shown along the web's path. These stations will be briefly described.

First, a primary charging station 117 is provided at which the photoconductive surface 109 of the web 105 is sensitized by applying to such surface a uniform electrostatic primary charge of a predetermined voltage. The station 117 includes an A.C. corona charger shown as a three wire A.C. charger. The output of the charger is controlled by a grid 117*a* connected to a programmable power supply 117*b*. The supply 117*b* is in turn controlled by the LCU 131 to adjust the voltage level Vo applied onto the surface 109 by the charger 117.

At exposure station 118, a light image of a document sheet original D supported on exposure platen 102 is projected onto the photoconductive surface 109 of the web 105 via mirrors 106, 108 and lens 107. The projected image dissipates the electrostatic charge at the light exposed areas of the photoconductive surface 109 and forms a latent electrostatic image. A programmable power supply 118*a*, under the supervision of the LCU 131, controls the intensity or duration of light from flashlamps 103 and 104 to adjust the exposure level E incident upon the web 105.

A magnetic brush developing station 119 includes developer which may consist of iron carrier particles and electroscopic toner particles with an electrostatic charge opposite to that of the latent electrostatic image. Developer is brushed over the photoconductive surface 109 of the web 105 and toner particles adhere to the latent electrostatic image to form a visible toner particle, transferable image. Other development systems than the one shown may be used; for example, see commonly assigned U.S. Pat. Nos. 4,473,029 to Fritz et al and 4,546,060 to Miskinis et al. A programmable power supply 119*d* may be provided to adjust the level of $V_B$, the voltage level applied to an electrode located in the station 119.

The copier 100 also includes a transfer station 121 shown as corona chargers 121*a* and 121*b*, at which the toner images on web 105 are transferred to a copy sheet S fed from a supply 123; and a cleaning station 125, at which the photoconductive surface 109 of the photoconductive layer is cleaned of any residual toner particles remaining after the toner images have been transferred and otherwise treated to restore its usefulness for the next exposure cycle. After the transfer of the unfixed toner images to copy sheet S, such sheet is transported to a heated pressure roller fuser 127 where the images are fixed to the copy sheet S.

To coordinate operation of the various work stations 117, 118, 119, 121 and 125 with movement of the image areas on the web 105 past these stations, the web has plurality of perforations along one of its edges. These perforations generally are spaced equidistantly along the edge of the web 105. For example, the web 105 may be divided into six image sectors or frames by F perforations; and each image area may be subdivided into 51 sections by C perforations. The relationship of the F and C perforations to the image areas is disclosed in detail in commonly assigned U.S. Pat. No. 3,914,047. At a fixed location along the path of the web movement, there is provided suitable means 130 for sensing web perforations. This sensing produces input signals into the LCU 131 which has a digital computer, preferably one or more microprocessors. The microprocessor has a stored program responsive to the input signals for sequentially actuating then de-actuating the work stations as well as for controlling the operation of many other machine functions. An encoder 160 associated with the roller 113 also produces timing signals for the logic and control unit 131. The signals from the encoder cause the unit 131 to fine tune the process.

Figure 5:
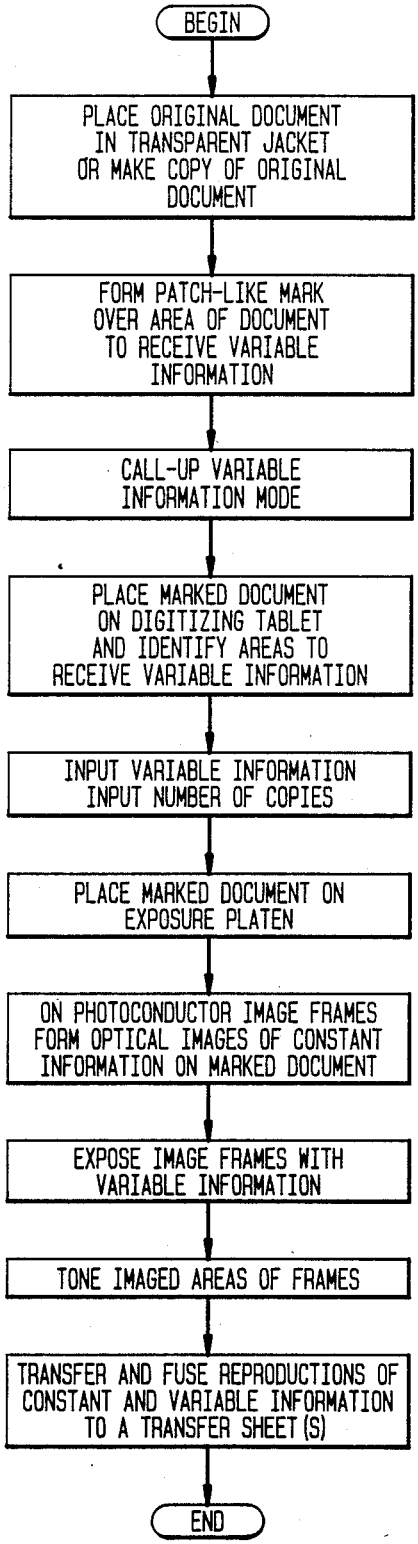
FIG. 5 is a flow chart of one method for carrying out the invention.
Figure 6:
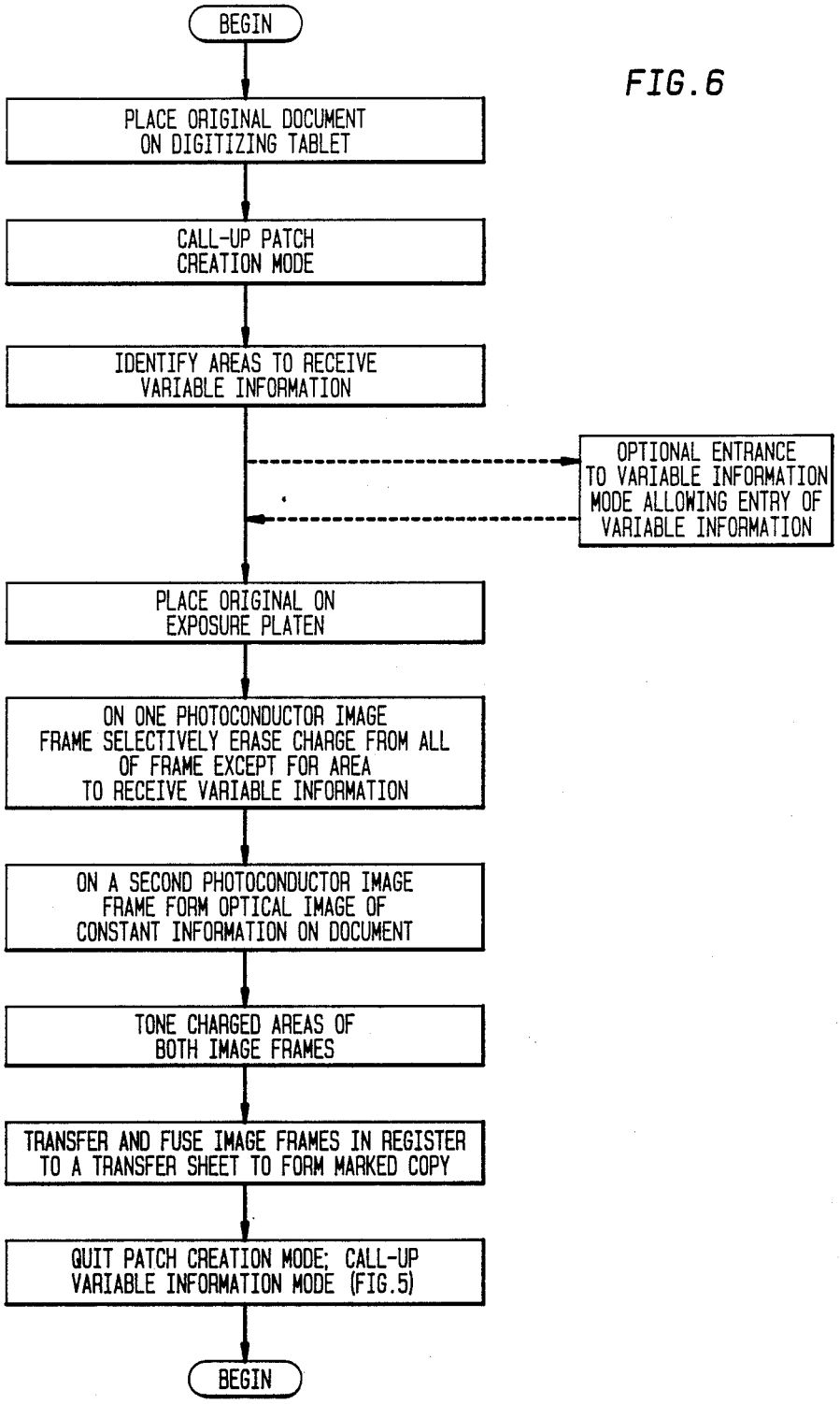
FIG. 6 is a flow chart of a second method for carrying out the invention.

Turning now to FIG. 4, a block diagram of logic and control unit (LCU) 131 is shown which interfaces with the copier 100. The LCU 131 consists of temporary data storage memory 132, central processing unit 133, timing and cycle control unit 134, and stored program control 136. Data input and output is performed sequentially under program control. Input data are applied either through input signal buffer 140 to an input data processor 142 or to an interrupt signal processor 144. The input signals are derived from various switches, sensors, and analog-to-digital converters. The output data and control signals are applied to storage latches 146 which provide inputs to suitable output drivers 148, directly coupled to leads. These leads are connected to the work stations and to a copy sheet registration feeding mechanism 126. A computer keyboard 135 is shown connected to the interrupt signal processor 144. This keyboard 135 can be conveniently located near the operator control panel CP, and all its buttons provide inputs into LCU 131. In response to an input from say a star (*) button or other special function button, a numeric code may be input into the LCU to call up a stored program for performing the type or mode of copy operation outlined in FIGS. 5 and 6. Alternatively, selection of such a mode may be made by a computer driven menu displayed on display 153 which comprises an output display screen for the LCU 131. The operation of the apparatus in this mode will now be described.

With regard also to FIG. 2, an operator first places the original document sheet D (in this case, document sheet 10) to be copied onto a digitizing tablet 190. A corner of the document sheet is registered in one corner of the digitizing tablet to establish a coordinate reference system for inputting information into temporary memory 132 regarding the location relative to a reference on the apparatus of the areas of the document sheet to contain the variable information. To enable the LCU 131 to receive this information, as indicated above, the special function key on the keyboard 135 and/or other keys are used to generate signals for calling up a program stored in stored program control 136. The LCU via instructions provided by display 153 requests that the operator indicate with use of a digitizing wand 194 associated with the digitizing tablet the position, relative to the registered corner of the document sheet, of the continuous tone areas to be selectively screened. For each rectangular marked area 14 shown the wand may be used to touch the sheet at the four corner points of each area. Preferably the points are touched in an order such that a straight line joins adjacent points as in the order a, b, c, and d to define a rectangle. Alternatively, a rectangle may be defined by locating two diagonally opposite corner points with an input indicating (or an assumption by the program) that it is a rectangle. The computer control for the digitizing tablet may also be programmed to accept inputs of area data to define other geometrical shapes such as circles and other geometric shapes. Transducers located beneath the sheet produce signals relating the position of the points touched relative to the registered upper left corner of the sheet. A digitizing tablet of this type may comprise transparent electrically conductive films spaced from each other wherein one of the films is a conductive layer and the other resistive and which make contact when pressure is exerted against one of them by a finger or probe. Other similar tablets using capacitive films may also be appropriate. Alternatively, the tablet may be of the known sonic type wherein, for example, a spark formed by means within a wand creates sound waves in the art which are sensed by microphones placed along the sides of the tablet or wherein a sensor is placed in the wand and sources at known points on the sides of the tablet emit sonic signals either in the air or through a glass platen. (See, for example, U.S. Pat. Nos. 4,012,588 in the name of Davis et al; 4,124,838 in the name of Kiss and 3,134,099 in the name of Woo.) A digitizer controller 196 knowing the time of emitting of the signals and their receipt can through triangulation principles calculate the location (i.e., x, y coordinates) of a point on the tablet relative to a known reference point such as the upper-left corner shown. The controller 196 for the digitizing tablet is programmed to recognize that the area is bordered by the straight lines joining adjacent points a, b, c and d and the coordinates for the points defining the area to be selectively written into can be thus calculated and communicated through interrupt signal processor 144 to be stored in temporary memory 132. This information is outputted on the display 153 showing the area to be written into. The coordinates for the points a, b, c and d would be $x_1$, $y_1$; $x_2$, $y_1$; $x_2$, $y_2$, and $x_1$, $y_2$, respectively. In order to display the appropriate size relationship between the area to receive the variable information and the size of the document sheet, the computer control for the digitizer may be programmed to permit entry of data regarding document size, either through buttons pressed on the keyboard or by allowing the operator to input this information by touching corner points e and f (or only corner point g) on the digitizing tablet. Alternatively, where only one size document sheet original will be sued with the apparatus, the size of the document sheet may be stored in the stored program control memory 136. Before use of the wand for each input, the operator will first identify the type of input by pressing the format input button 157 or area input button 158. When introducing area input information the operator will also provide using the keyboard 135 the variable information to be printed in the area a, b, c, d. As the invention is intended to be best utilized where the variable information differs from copy to copy, the program preferably allows the variable information to be input for each copy. This may be done by a menu prompt indicating if different variable information is to be done for another copy. The illustration on the display may then indicate a highlighted area a, b, c, d, and request the variable information for copy number 2. This may repeat for each copy. Alternatively, a disc drive may be provided as part of an electronic data generator 152 to permit variable data such as address lists and names to be input directly and the operator need only identify the areas to which the variable information is to be placed using the digitizing tablet. Where multiple areas on each copy are to contain variable information, the program may provide for input of the variable information in various orders. For example, the program may request the variable information to go into one area for each copy and then request the variable information that goes into each copy for the other area. Alternatively, all the information to go on a first copy sheet may be requested and then all the information to go on a second copy sheet is requested and so on. After the area is defined using the wand 194 and the variable information defined using the keyboard 135 or other source, the store button 167 is pressed to retain this information in memory in conjunction with this particular portion of the document sheet. Inputs for each of the buttons and keyboard provide digital level signals to the interrupt signal processor 144 for storage in the LCU's temporary memory 132.

If there is another area to be reproduced with variable information, the operator moves the wand over the points designating this area on the document sheet. This information is also stored and displayed on the display by pressing the store button 167 and the variable information input as described above.

The operator next places the document sheet original D or 10 on the exposure platen 102 face down with the document sheet appropriately registered such as with an edge suitably centered against a registration edge on the platen or with some copiers registered with a corner. The number of copies to be made may be input or may be input earlier while identifying the variable information. For example, the menu prompts in requesting the variable information for each copy may request the number of copies of that copy having that particular variable information. Normally, one copy of each will be desired and can be provided as a default if another number is not input. However, there may be times where different numbers of each copy are desired. A SPECIAL PRINT button 164 is depressed which signals the LCU to make the copies using the information inputted about the areas to receive variable information.

The program for operating the copying operation may be such as to not inhibit operation of the copier until actual copies are being made using the SPECIAL PRINT operation or variable information mode. This is desirable in that it allows one operator to input information about the variable information and locations thereof using the digitizing tablet while the same or a second operator may be making copies of say another job.

However, where compactness is preferred the digitizing tablet as shown in FIG. 1 may be combined with the exposure platen 102 so that a document resting upon the platen glass face-up and suitably registered by a corner or edge thereof may have its size and areas to receive variable information determined using wand 194 as described previously. The document can then be flipped over top-to-bottom so that the document remains registered either centered against its edge or a corner thereof located in the platen's registration corner. A digitizing tablet using a transparent platen without visible grid lines or at least not "visible" to the photoconductor has a distinct advantage over other types of digitizers since it can be located at the exposure platen of a copier apparatus with the transparent glass exposure platen serving as both the support for digitizing purposes and as the support for the exposure operation. Providing the digitizer without visible grid lines will also not impose constraints on the type of photoconductor or exposure light source used since it is not desirable to reproduce the lines of the grid on any reproduction. Original document sheet D or 10 as indicated above and shown in FIG. 1(*a*) includes constant information 12 and white reflective background portions. In synchronization with the location of a first image sector $E_1$ at exposure station 118, the flash lamps 103, 104 are illuminated and an optical image of the entire document, D, is simultaneously flash exposed onto the primary charged photoconductive surface 109 of this image sector. A latent electrostatic image of the constant information is thereby formed on the previously charged image sector $E_1$. The primary electrostatic charge on the area of image sector $E_1$ corresponding to patch area a, b, c, d remains unaffected by the flash exposure of document D on image from $E_1$ due to the nonreflectivity of the black patch. Opposite the photoconductive surface 109 there is also provided another illumination source 192 which comprises a plurality of light emitting diodes (LED's) 198 arranged in a row lying across the width of the web 105. These LED's are coupled to the output drivers 148 of the LCU. A SELFOC (trademark of Nippon Sheet Glass Company, Ltd.) gradient index lens ray (GRIN) 197 is located proximate the web and is also directed transverse to the direction of web movement. The GRIN 197 focuses the light from the LED's onto the surface 109 of the web. The LED printhead 192 may be located as shown after the exposure area 118 or more preferably before the exposure area such as opposite roller 110. The important consideration being that it be located between charger station 117 and development station 119.

Prior to or as the first image sector $E_1$ on the photoconductive web 105 upon which the image of the document sheet D or 10 is to be formed passes above the GRIN, the LCU calculates in response to signals provided by electronic data generator 152 which of the LED's to illuminate and the duration for each such exposure to cause the LED to modulate the charge in the area on $E_1$ corresponding to a, b, c, d with image information that will reproduce character information in accordance with the variable information input via keyboard 135. As shown in FIG. 4, the portions of the printhead LED's between the ordinates $y''_1$, $y''_2$ on the Y'' axis of the linear printhead correspond to their respective counterpart locations on the original document and to their respective ordinate counterpart locations $Y'_1$, $y'_2$ on the y' axis of the image frame. This ordinate pair defines a transverse line past which the respective electrostatic image area corresponding to the patch will pass. When this area corresponding to the patch beings to pass directly above the LED printhead, the appropriate LED's are turned on by the LCU. The parameters for determining the timing of when to commence illumination and when to terminate illumination of the respective LED's are provided by the abscissa pair $x'_1$, $x'_2$ of the image frame, respectively and the character information input by electronic data generator 152. Thus, when the portion of the image frame corresponding to the transverse line $x'_1$, as determined by signals provided by the LCU, overlies the linear printhead array the LED's providing illumination between $y''_1$ and $y''_2$ are illuminated selectively to provide a latent image of the variable information in this area. This is done by pulsing the appropriate LED's at appropriate times in accordance with a bit stream of data signals that are fed to the LED's. Accompanying the LED's are logic chips and driver circuits for enabling the LED's in accordance with use of well known circuitry. The LED's may also be used to serve as an interframe or format erase in accordance with known practice of combining an electronic printer to serve to "print" image information and serve as a programmable light source for erasing areas external to an image frame to prevent such areas from becoming toned with toner.

For producing additional copies, the document D is again exposed by flash illumination frame lamps 103 and 104 and forms an electrostatic latent image at station 118 on the second image sector $E_2$. When the second image sector passes above the linear printhead. The LCU 131 in accordance with electronic signals assembled by the electronic data generator 152 outputs to the LED's signals to have the LED printhead modulate the area corresponding to the patch on image frame $E_2$ with the variable information for the second copy. Note this variable information may be the same as provided on image frame $E_1$ if two or more copies of the composite information to be produced by image frame $E_1$ is desired. Alternatively, this variable information may be different for example where the copy to be reproduced using image frame $E_2$ is to be sent to a party different than that to receive the copy made from image frame $E_1$. Where multiple copies of the composite information provided on image frame $E_1$ are desired, it may be desirable to make a single copy set of each of the different reproductions, and then make further sets of copies so that finished sets will be stored in the tray 170 at the output.

The electrostatic images remaining on each image sector is developed at development station 119 and transferred to copy sheet S in register as will be now described.

Receiver or copy sheets S are stored in a supply stack supported in a hopper 123 within the copier frame. A feeder 126, such as an oscillating vacuum feeder, removes a sheet S from the stack and delivers the sheet through a guide 138 into contact with the traveling web 105. Timing of actuation of the feeder 126 is controlled by the LCU so that the fed receiver sheet reaches the web 105 with its lead edge in register with the lead edge of the image sector $E_1$ containing the first developed image of document D. The receiver sheet travels with the web beneath a first transfer corona charger 121*a* located adjacent to the periphery of the web travel path on the same side of the web as the receiver sheet. The corona charger 121*a* has an impressed D.C. voltage sufficient to produce an ion flow which charges the receiver sheet to the extent that toner particles of the first developed image are attracted from the web to the receiver sheet.

After the transfer of the composite image to the receiver sheet, the receiver sheet is detached from the web 105 using charge 121*b* and moved along a path away from the web by a sheet transfer apparatus such as, for example, a vacuum transport 165. The transport 165 engages the receiver sheet on the opposite side from the toner image so as not to disturb or smear the toner image. The vacuum transport 165 delivers the sheet to a fixing apparatus such as, for example, roller fuser 127. The fuser 127 applies heat and pressure to the composite toner image and receiver sheet to fuse the toner image and permanently fix the image to the receiver sheet. The receiver sheet is then delivered to an exit hopper 170. While the image is being fixed to the receiver sheet, the web 105 continues to travel about its path through cleaning area 125. In the cleaning area, a fiber brush rotating in a vacuum housing (not shown), for example, contacts the web to remove any residual, nontransferred toner. To facilitate toner removal the web 105 may be subjected to illumination from an erase lamp to cancel any field within the photoconductor and charge from an A.C. charger 181 to neutralize the charge on the web. The web then travels back under the primary charger 117 where it is recharged with a uniform primary electrostatic charge so that the reproduction cycle can be repeated. As may be seen in FIG. 1(*b*) the resulting copy sheet S includes a reproduction of the constant information portion of original document 10 and a reproduction of the variable information input by keyboard 135.

The production of subsequent copies is handled similarly so that the composite image on image frame $E_2$ is transferred to a second receiver sheet and so on.

Thus, apparatus and method are provided wherein each image frame is exposed to a full-frame flash exposure of the constant image information of document D and the LED printhead or other suitable electronic print source provides a variable information input on the same image frame in the area masked off from exposure by the patch. The selection of the area in each frame to receive the variable information is quite flexible as will be noted since with use of the digitizing tablet any area of any size fitting within the image frame can be selected. Also the use of flash exposure of the image frame for the constant information and exposure of the same image frame with the variable exposure provides for reproductions at the full machine rate of the apparatus and thus provides for a highly productive reproduction apparatus.

In the embodiments described above, the black patch or ink mark was either provided directly on an original or placed on a transparent folder within which the original was placed or a copy made of the original document sheet and the patch placed on the copy. In the following embodiment description will be made of apparatus and method wherein the document sheet containing the constant information and a patch is first made by the reproduction apparatus. With reference now to the flow chart of FIG. 6 and the illustration of FIG. 7, description of this embodiment will now be made in conjunction with the apparatus of FIGS. 2–4. In order to make reproductions of an original document sheet with the reproductions containing the constant information of the original and additional information as described above, the operator places the original upon the digitizing tablet 190. The star button with a code number or other means such as a menu prompter on display 153 and inputs from keyboard 135 select a patch creation mode. When this mode is called up with signals from keyboard 135 a computer program in stored program control 136 outputs instructions via drivers 148 to display 153 to inform the operator to place the original on the digitizing tablet 190 and enter the size of the original and the first area using the digitizing wand 194 as described previously. Assume in this example that a patch is desired to be created on area a, b, c, d of document sheet 10 in FIG. 1(*a*). With the area defined by input of the points a, b, c, d (or a, c, if a rectangle) a prompt may be provided to identify the variable information for each copy sheet and number of copies. Alternatively, this input may be deferred to a later time such as when operating in the variable information mode. The display 153 facilitates insertion of the variable information by highlighting the area to receive same as the display illustrates the size of the copy sheet and outlines of the area to receive the variable information. Note that usually the copy sheet size and original size will be the same but the machine also may be programmed to provide as display of the copy sheet to show where the variable information will go into the reproductions.

Figure 7:
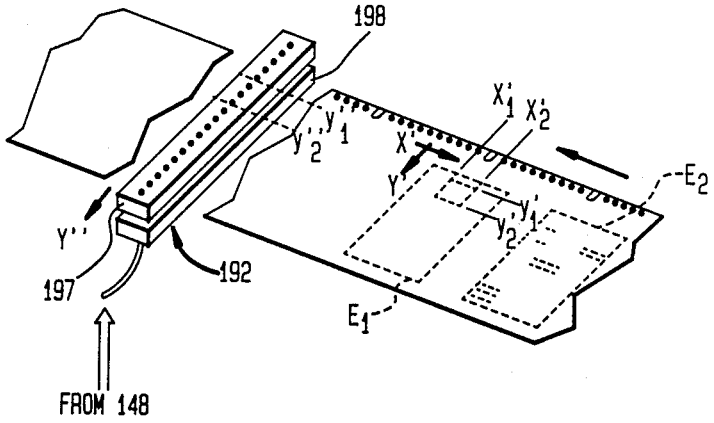
FIG. 7 is a sketch of a photoconductive member and an electronic print source of the apparatus of FIGS. 2–4 and used to produce a document having constant information and a patch-like marking.

Following the input of the information needed to form the reproductions, the operator is directed to place the document sheet face down upon the exposure platen 102 so that it is approximately registered with a suitable reference or registration point. The document sheet D or 10 is then flash exposed at station 118 onto image frame $E_2$ as shown in FIG. 7. On image frame $E_1$ no optical exposure of this image frame is made of the document sheet but instead the LCU 131 drives the appropriate LED's 198 via signals from drivers 148 (FIG. 4) to erase charge from all image areas of $E_1$ but for the area which corresponds to a, b, c, d (i.e., the area defined by the coordinates $X'_1$, $y'_1$; $x'_2$, $Y'_1$; $x'_2$, $y'_2$; $x'_1$, $y'_2$). The two image frames are then developed at development station 119 and the two image frames are transferred in register to the same surface of a receiver sheet S as will now be described.

As described previously, timing of actuation of the feeder 126 is controlled by the LCU so that the fed receiver sheet reaches the web 105 with its lead edge in register with the lead edge of the image sector $E_1$ containing the first developed image frame $E_1$ which in this instance contains only a toned area that will form the patch. The receiver sheet travels with the web beneath the first transfer corona charger 121*a* located adjacent to the periphery of the web travel path on the same side of the web as the receiver sheet. The corona charger 121*a* has an impressed D.C. voltage sufficient to produce an ion flow which charges the receiver sheet to the extent that toner particles of the first developed image, i.e. the patch, are attracted from the web to the receiver sheet.

In order to register the receiver sheet with the next developed image on image frame $E_2$, the receiver sheet is removed from the web and then returned into contact with the web as the area bearing the next image reaches the location where the receiver sheet is returned to the web. Specifically, removal and return of the receiver sheet is accomplished by register means located downstream of the transfer corona charger 121*a*. The register means may be, for example, a roller 121*c* in juxtaposition with the web 105. The roller 121*c* has a circumference equal to the dimension of one image area of the web (in the direction of web travel) plus the distance between two adjacent areas, and is rotated at an angular velocity so that the tangential velocity at the periphery of the roller equals the linear velocity of the web. Drive for the roller 121*c* is preferably provided by a stepper motor $M_2$ which receives actuating signals from the LCU.

When the lead edge of the receiver sheet reaches the element of the roller 121*c* closest to the web, the lead edge is tacked to the roller, such as by vacuum from a vacuum source connected to the roller and operative through ports in the roller, or any other appropriate means. The tacking action (induced by the vacuum) is controlled by the LCU so that, as the roller 121*c* is rotated, the receiver sheet is removed from the web 105 and rotates with the roller as the web continues to move along its travel path. Since the image bearing surface of the receiver sheet does not contact the roller, the transferred image is not disturbed by the register means. Continued movement of the web and synchronized rotation of the roller brings the lead edge of the receiver sheet back into contact with the web as the lead edge of the next image area bearing the constant image information on image frame $E_2$, arrives at the recontact location. At this point in time, based on signals provided by encoder 160 to the LCU, the receiver sheet is detached from the roller (vacuum supply interrupted by the LCU to enable the sheet to travel with the web). In this manner, the image in the next image frame $E_2$ is in registered superimposed relation to the previously transferred image (i.e. the patch) on the receiver sheet.

The web and the registered receiver sheet then travel beneath a second transfer corona charger 121*b* located adjacent to the periphery of the web travel path on the same side of the travel path as the receiver sheet. The corona charger 121*b* functions, substantially in the same manner as the corona charger 121*a*, to transfer the second developed image to the receiver sheet. The D.C. voltage impressed upon the corona charger 121*b* is controlled by the LCU and may be different from the voltage impressed upon corona charger 121*a*. Since the second image on the web is in register with the first image on the receiver sheet, accurate superimposed transfer of the second image onto the same surface of the receiver sheet relative to the first image occurs.

After the transfer of the second image is complete, the receiver sheet is detached from the web 105 and moved along a path away from the web by a sheet transfer apparatus such as, for example, a vacuum transport 165. The transport 165 engages the receiver sheet on the opposite side from the toner image so as not to disturb or smear the toner image. The vacuum transport 165 delivers the sheet to a fixing apparatus such as, for example, roller fuser 127. The fuser 127 applies heat and pressure to the composite toner image and receiver sheet to fuse the toner image and permanently fix the image to the receiver sheet. The receiver sheet is then delivered to an exit hopper 170. While the image is being fixed to the receiver sheet, the web 105 continues to travel about its path through cleaning area 125, as described previously.

The reproduction produced contains the constant information of document D and a patch over the area corresponding to area a, b, c, and d. This reproduction may now be placed on the exposure platen face down and used as the marked copy for producing reproductions containing a composite of constant image information and variable image information as described previously. The order of making the marked copy may be reversed with image frame $E_1$, receiving the constant information and image frame $E_2$ being used to form the patch.

While the invention has been described in connection with web type photoconductors, the invention in its broader aspects contemplates other configurations such as drums, plates, etc. The invention may be used to advantage in highly productive apparatus using recirculating feeders. For example, the document sheet 10 to be reproduced may be part of a multisheet document. The program for operating in the variable information mode may allow the operator to enter the position of the document 10 in the stack of documents and reproduce same in accordance with the procedures described above for providing variable information on the reproductions of one or more document sheet in the stack. The variable data may also comprise page numbering wherein it is desired to serially page number reproductions of document sheet that are to form a multisheet document. A black patch mark may be placed say on each of the originals and if the patch location is the same for all, only one area need be identified by the operator using the digitizing tablet. A program may be called up to have electronic data generator 152 create signals for electronically exposing, using the LED printer, onto the corresponding patch areas of each image frame reproducing an original a different number in the appropriate order, thus after toning and transfer providing a serially numbered set of reproductions. The roller 121*c* may be modified to be electrically charged so that it serves as a transfer roller also. In lieu of using a roller to register two image frames in one of the described embodiments wherein the patch is formed by the apparatus a tray may be provided and appropriate means for directing the receiver sheet containing a transferred image from one image frame for temporary storage until a second image frame is in position for transfer of its image to such receiver sheet. The sheet may then be removed by automatic feeding means and guided back in engagement with the web for transfer of the image on the second image frame.

Thus, there has been disclosed highly productive electrophotographic reproduction apparatus for producing constant and variable information on reproductions with great flexibility as to the area in which the variable information may appear.

The invention has been described in detail with particular reference to preferred embodiments thereof, but it will be understood that variations and modifications can be effected within its spirit and scope of the invention.

We claim:

1. A method for producing copy that is a composite of constant information from an original document and additional variable information, the method comprising:

(a) placing the document on a support, the document having a patch-like marking corresponding to the area to receive the variable information and while on the support, having the operator manually select points that identify the patched area to receive variable information, such selection step causing signals to be created with respect to such points that are related to the x, y coordinates of each of such points relative to a reference;

(b) generating signals corresponding to variable information to be printed on the copy;

(c) placing the document on an exposure platen;

(d) optically exposing the document onto an image frame of an electrostatically charged photoconductive member to form an electrostatic latent image of the constant information;

(e) in response to signals generated in step (b) separately exposing, using an electronic print source, onto the same image frame an electrostatic latent image of character information in the area of the frame corresponding to the patch-like marking;

(f) developing the latent images formed by the image frame; and (g) transferring the developed image to a receiver sheet to form the copy with the composite information.

2. The method of claim 1 wherein in step (d) the constant information is optically exposed onto said image frame using a flash exposure that simultaneously exposes the entire image of the document onto the image frame.

3. The method of claim 2 and wherein in step (a) a pen-like wand is used to identify the x, y coordinates of the points identifying the patched area.

4. The method of claim 1, 2 or 3 and wherein a document having a patch-like marking is produced by the further steps of:

(h) placing the document having the constant information on the support;

(i) having the operator manually select points that identify a patched area to be formed on a reproduction, such selection causing signals to be generated with respect to such points that are related to the x, y coordinates of each of such points relative to a reference;

(j) placing the document on an exposure platen;

(k) optically exposing the document onto one image frame of the electrostatically charged photoconductive member to form an electrostatic latent image of the constant information;

(l) in response to the signals generated in step (i) exposing, using the electronic print source, onto a second image frame to erase charge from all areas thereof except for charge in an area corresponding to that which will be used to form a patch-like marked area;

(m) developing the electrostatic latent image formed in step (k) and developing the area left with charge in step (l);

(o) transferring the two developed image frames in register to the same surface of a receiver sheet to form a document having the constant information and a patch-like marking; and (p) using the receiver sheet formed in step (o) as the document in step (a).

5. A method for producing copy that is a composite of constant information from an original document and additional variable information, the method comprising the steps of:

(a) placing the document having the constant information on a support;

(b) having the operator manually select a location that identifies a patched area to be formed on a reproduction, such selection causing signals to be generated with respect to such location that are related to the position of such location relative to a reference;

(c) with a document containing the constant information on an exposure platen optically exposing the constant information onto one image frame of an electrostatically charged photoconductive member to form an electrostatic latent image of the constant information;

(d) in response to the signals generated in step (b) exposing, using an electronic print source, onto a second image frame to erase charge from all areas thereof except for charge in an area corresponding to that which will be used to form a patch-like marked area;

(e) developing the electrostatic latent image formed in step (c) and developing the area left with charge in step (d);

(f) transferring the two developed image frames in register to the same surface of a receiver sheet to form a patched document having the constant information and a patch-like marking; and (g) with the patched document on the exposure platen, optically exposing the patched document onto an image frame of an electrostatically charged photoconductive member to form an electrostatic latent image of the constant information;

(h) separately exposing, using an electronic print source, onto the same image frame of step (g) an electrostatic latent image of character information in the area of the frame corresponding to the patch-like marking;

(i) developing the latent images formed on the image frame in steps (g) and (h); and (j) transferring the developed images to a receiver sheet to form the copy with the composite information.

6. The method of claim 5 and including the step of repeating steps of (g), (h), (i) and (j) to make multiple reproductions on different receiver sheets of the composite and variable information, the variable information exposed in step (h) being different from image frame to image frame.

7. A method for producing multiple composite reproductions of an original document sheet in a highly productive reproductive apparatus wherein the reproductions are to contain additional annotations, the method comprising the steps of:

(a) selecting a location that is related to an area where the annotation is to be reproduced and generating signals in accordance with such selection;

(b) in response to said signals, operating said apparatus to form reproductions of the original with a patch imaged on the area to receive the annotations;

(c) placing the patched reproduction formed in step (b) on an exposure platen of said apparatus and producing multiple composite reproductions of the original document with each reproduction containing information of the original document and additional annotated information, the information of the original document and additional annotated information for each reproduction of the document sheet being formed on one image frame of an intermediate image member of said apparatus in a composite arrangement.

8. The method of claim 7 and wherein the additional information formed on the intermediate member varies from reproduction to reproduction while the portions of the information reproduced from the original document sheet is constant.

9. An apparatus for producing a copy that is a composite of constant information from an original document and additional variable information, the document including a patch-like marking corresponding to the area to receive the variable information, the apparatus comprising:

(a) digitizing means for supporting the document and for enabling the operator to manually select points that identify the patched area to receive variable information to generate a first set of signals that are related to the x, y coordinates of each of such points relative to a reference;

(b) means for generating a second set of signals corresponding to variable information to be printed on the copy;

(c) an exposure platen;

(d) a photoconductive member;

(e) means for electrostatically charging the photoconductive member;

(f) exposure means for optically exposing the document onto an image frame of the electrostatically charged photoconductive member to form an electrostatic latent image of the constant information;

(g) means including an electronic print source and responsive to the second set of signals for separately exposing, onto the same image frame an electrostatic latent image of character information in the area of the frame corresponding to the patch-like marking;

(h) means for developing the latent images formed on the image frame; and (i) means for transferring the developed image to a receiver sheet to form the copy with the composite information.

10. The apparatus of claim 9 and wherein the exposure means optically exposes the constant information onto said image frame using a flash exposure that simultaneously exposes the entire image of the document onto the image frame.

11. The apparatus of claim 10 and wherein the digitizing means includes a pen-like wand that is used to identify the x, y coordinates of the points identifying the patched area.

12. The apparatus of claims 9, 10 or 11 and including means forming a document with the constant information and the patch-like marking by exposing a document having the constant information onto one image frame of the photoconductive member using the optical exposure means to form a latent electrostatic image of the constant information and exposing a second image frame using the electronic print source to erase areas thereof, except for the area corresponding to where the patch-like marking is to be reproduced.

13. An apparatus for producing copy that is a composite of constant information from an original document and additional variable information, the apparatus comprising:

(a) an electrostatically chargeable photoconductive member;

(b) means for charging the member;

(c) means for supporting a document having the constant information;

(d) means for generating signals in response to a manually selected location that identifies a patched area to be formed on a reproduction, such signals being related to the position of such location relative to a reference;

(e) means for exposing a document containing constant information onto one image frame of the electrostatically charged photoconductive member to form an electrostatic latent image of the constant information;

(f) means responsive to said signals for exposing, using an electronic print source, onto a second image frame of the member to erase charge from all areas thereof except for charge in an area corresponding to that which will be used to form a patch-like area;

(g) means for developing the electrostatic latent image of the constant information and developing the area corresponding to that which will be used to form a patch-like marked area;

(h) means for transferring the two developed image frames in register to the same surface of a receiver sheet to form a patched document having the constant information and a patch-like marking; and (i) means for optically exposing the patched document onto an image frame of the electrostatically charged photoconductive member to form an electrostatic latent image of the constant information;

(j) means for separately exposing, using the electronic print source, onto the same image frame of paragraph (i) an electrostatic latent image of character information in the area of the frame corresponding to the patch-like marking;

(k) means for operating the developing means for developing the latent images formed on the image frame containing the constant information and the character information printed by the electronic print source; and (l) means for transferring the developed images of the constant information and character information to a receiver sheet to form the copy with the composite information.

14. An apparatus for producing multiple composite reproductions of an original document sheet in a highly productive reproduction apparatus having an image forming element and wherein the reproductions are to contain additional annotations, the apparatus comprising:

(a) means for selecting a location that is related to an area where the annotation is to be reproduced and generating signals in accordance with such selection;

(b) means, responsive, to said signals, for operating said apparatus to form reproductions of the original with a patch imaged on the area to receive the annotations;

(c) an exposure platen for supporting the patched reproduction;

(d) means for exposing said patched reproduction and for producing multiple composite reproductions of the original document with each reproduction containing information of the original document and additional annotated information, the information of the original document and additional annotated information for each reproduction of the document sheet being formed on one image frame of the image forming element of said apparatus in a composite arrangement.

* * * * *